United States Patent [19]

Takeda et al.

[11] Patent Number: 4,982,716

[45] Date of Patent: Jan. 8, 1991

[54] FUEL INJECTION VALVE WITH AN AIR ASSIST ADAPTER FOR AN INTERNAL COMBUSTION ENGINE

[75] Inventors: Keiso Takeda, Mishima; Taiyo Kawai, Susono; Kiyoshi Nakanishi, Suson; Michiaki Ujihashi, Mishima; Yuichi Takano, Susono, all of Japan

[73] Assignee: Toyota Jidosha Kabushiki Kaisha, Toyota, Japan

[21] Appl. No.: 309,862

[22] Filed: Feb. 14, 1989

[30] Foreign Application Priority Data

Feb. 19, 1988 [JP] Japan ..... 63-19874[U]

[51] Int. Cl.[5] ..... F02M 23/00

[52] U.S. Cl. ..... 123/531; 123/470; 239/533.12; 239/432

[58] Field of Search ..... 123/470, 585, 590, 531, 123/472; 239/432, 533.12

[56] References Cited

U.S. PATENT DOCUMENTS

| | | | |
|---|---|---|---|
| 1,511,820 | 10/1924 | Rochefort | 123/531 |
| 4,434,766 | 3/1989 | Matsuoka | 123/531 |
| 4,657,189 | 4/1987 | Iwata | 239/533.12 |
| 4,771,948 | 9/1988 | Furukawa | 239/533.12 |
| 4,773,374 | 9/1988 | Kiuchi | 123/470 |
| 4,828,181 | 5/1989 | Singels-Craenen | 123/432 |
| 4,846,405 | 7/1989 | Zimmermann | 239/432 |

FOREIGN PATENT DOCUMENTS

| | | | |
|---|---|---|---|
| 59-1722267 | 11/1984 | Japan . | |
| 61-57166 | 4/1986 | Japan . | |
| 61-164470 | 10/1986 | Japan . | |
| 61-187963 | 11/1986 | Japan . | |
| 61-198574 | 12/1986 | Japan . | |
| 62-101067 | 6/1987 | Japan . | |
| 0186112 | 8/1987 | Japan | 239/432 |

*Primary Examiner*—Carl Stuart Miller
*Attorney, Agent, or Firm*—Kenyon & Kenyon

[57] ABSTRACT

A fuel injection valve includes an injector body having a fuel injection hole and an adapter having a fuel collision surface, two air injection holes and two injected fuel paths. The fuel injected from the fuel injection hole flows in a slug-like pattern and collides with the fuel collision surface where the fuel is atomized a first time. Then, the fuel flows in a direction away from an axis of the adapter in a membrane-like pattern getting thinner in thickness to be finally broken to pieces, that is, to be atomized a second time. The air injected from the air injection holes collides with the membrane-like pattern of fuel to be atomized a third time before the fuel goes out of the injected fuel paths.

13 Claims, 3 Drawing Sheets

FUEL INJECTION VALVE WITH AN AIR ASSIST ADAPTER FOR AN INTERNAL COMBUSTION ENGINE

BACKGROUND OF THE INVENTION

1. Field of the Invention

The present invention relates to a fuel injection valve for an internal combustion engine. More particularly, the invention relates to a fuel injection valve having two injected fuel paths and improved fuel atomizing.

2. Description of the Related Art

Electro-magnetic fuel injection valves having two injected fuel paths are known as taught in, for example, Japanese Utility Model Publication SHO 61-198574. Further, techniques of atomizing a fuel by letting an air stream collide with the fuel are known as taught in, for example, Japanese Utility Model Publications SHO 59-172267 and SHO 61-164470, though the fuel injection valves of the publications are ones with a pintle type needle valve which are not the type used in the present invention.

More particularly, Japanese Utility Model Publication 61-198574 discloses a basic structure of a fuel injection valve of the same type as the present invention, that is, a fuel injection valve including an injector body having a single fuel injection hole and an adapter, coupled to the injector body, having a dead volume portion, two injected fuel paths communicating with the dead volume portion, and a dividing wall located between the injected fuel paths. In the fuel injection valve, the fuel injected from the fuel injection hole flows in the dead volume portion in a slug-like pattern and then is divided into two portions by the dividing wall. Each of the two portions passes through each injected fuel path and is injected into an intake port of the engine. The fuel is injected into the intake port substantially in a slug-like pattern, because the fuel is not effectively atomized in the adapter Though the dividing wall opposes the fuel injection hole, the top surface of the dividing wall is upwardly edged for the purpose of making the flow resistance as small as possible. As a result, the top surface of the dividing wall cannot let the fuel collide with the top surface at a nearly right angle and cannot atomize the fuel. The fuel injection valve does not use a technique to let an air stream collide with the fuel for atomizing the fuel.

Though the technique using an air stream for atomizing a fuel is taught in Japanese Utility Model Publication SHO 59-172267, the fuel injection valve disclosed in the publication relates to a fuel injection valve with a pintle type needle valve which has a too different fuel injection mechanism to attempt to apply the mechanism to a fuel injection valve having no pintle type needle valve. In more detail, in the fuel injection valve having a pintle type needle valve, the fuel is injected through an annular clearance defined between the needle valve and an inside surface of a fuel injection hole and flows in a cone-like pattern from the beginning, while in the fuel injection valve without a pintle type needle valve, the fuel injected from a fuel injection hole flows in a slug-like pattern. Even if the technique of letting the air collide with the fuel disclosed in the publication could be applied to a fuel injection valve having no pintle type needle valve, a high fuel atomizing effect could not be obtained, because the air collides with fuel which has not collided with a surface of the adapter and thus has not been promoted in atomizing.

Japanese Utility Model Publication SHO 61-164470 also discloses a fuel injection valve with a pintle type needle valve. In the fuel injection valve, the air injected from air injection holes does not operate to atomize the fuel but operates only to cause a swirl in the adapter. Further, in the publication, there is no suggestion of letting the fuel collide with a top surface of the dividing wall, because the lower end surface of the pintle type needle valve is located close to the top surface of the dividing wall, and the fuel cannot collide with the top surface of the dividing wall.

As will be apparent from the above discussion, though some of the prior art fuel injection valves having a pintle type needle valve include air injection holes, the techniques of the air injection holes are difficult to apply to a fuel injection valve having no pintle type needle valve, especially to a fuel injection valve having a fuel injection hole for injecting fuel in a slug-like pattern and two injected fuel paths for letting the fuel injected from the fuel injection hole pass therethrough. Thus, the fuel atomizing characteristic of a fuel injection valve having no pintle type needle valve is problematic. In more detail, the fuel injected from the fuel injection valve comprises two slug-like patterns of fuel which is composed of the flow of a lot of fuel drops having a comparatively large drop diameter. Such fuel flow with large sized fuel drops is likely to cause insufficient fuel evaporation in a cylinder of the engine as well as insufficient mixing of the fuel with air in the intake port and the cylinder As a result, carbon, deposits around the spark plugs and an increase of HC and CO gases in the exhaust gas will occur.

SUMMARY OF THE INVENTION

An object of the invention is to provide a fuel injection valve without a pintle type needle valve in which two injected fuel paths are provided where fuel is sufficiently atomized before it is injected from the injected fuel paths into an intake port of an engine.

The above-described object is attained by a fuel injection valve with an air assist adapter for an internal combustion engine in accordance with the present invention. The fuel injection valve includes an injector body having a fuel injection hole for injecting fuel in a slug-like pattern and an adapter coaxially coupled to the injector body. The adapter includes a recessed concave portion, a fuel collision surface, two air injection holes, and two injected fuel paths. More particularly, the concave portion defines a dead volume portion therein. The fuel injected from the fuel injection hole in a slug-like pattern flows within the dead volume portion. The fuel collision surface is located so as to be spaced from and axially opposite to the fuel injection hole and lets the fuel flowing from the fuel injection hole toward the fuel collision surface collide with the fuel collision surface to thereby change the fuel flow direction from a direction toward the fuel collision surface to a direction away from an axis of the adapter and to change the fuel flow pattern from the slug-like pattern to a membrane-like pattern. The air injection holes inject air streams against the membrane-like pattern of fuel from an upper side of the membrane-like pattern of fuel to thereby assist the fuel in being atomized. The injected fuel paths are formed on sides of the fuel collision surface and let the atomized fuel and the injected air pass therethrough into an intake port of an engine.

In the above-described fuel injection valve, the fuel injected from the fuel injection hole is effectively atomized through three atomizing steps before it is injected from the injected fuel paths into the intake port of the engine. In more detail, the fuel injected from the fuel injection hole flows in the dead volume portion toward the fuel collision surface in a solid slug-like pattern. When the slug-like pattern collides with the fuel collision surface, the fuel will be atomized as a first step of atomizing due to the collision, and the flow direction is changed from the direction along the axis of the adapter to a direction away from the axis of the adapter. Such a fuel flow flowing in the direction away from the axis of the adapter comprises a membrane-like pattern of fuel. When the fuel flows radially outwardly, the thickness of the membrane will decrease in proportion to an increase in the radius of the membrane-like flow because of the principle that the volume flow is maintained constant in a continuously flowing film, the membrane-like pattern of fuel breaks up, that is, atomized. This is a second step of atomizing of fuel. Then, the air injected from the air injection holes collides with the breaking-up membrane-like pattern of fuel to assist in the atomization of the fuel. This is a third atomization step of the fuel. In this way, the fuel is sufficiently atomized before it flows out of the fuel injected fuel paths.

BRIEF DESCRIPTION OF THE DRAWINGS

The above and other objects, features and advantages of the present invention will become apparent and more readily appreciated from the following detailed description of the preferred exemplary embodiments of the invention taken in conjunction with the accompanying drawings, in which.

DETAILED DESCRIPTION OF THE PREFERRED EMBODIMENTS

Figure 1:
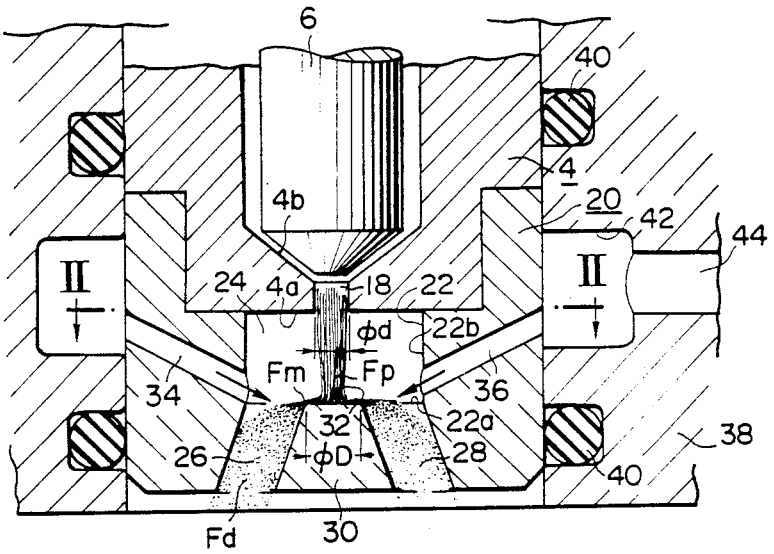
FIG. 1 is a partial cross-sectional view of a fuel injection valve provided with an air assist adapter in accordance with a first embodiment of the present invention in which the adapter and adjacent parts are illustrated.

Two embodiments will be explained. Because a first embodiment, which is illustrated in FIGS. 1 to 4, and a second embodiment, which is illustrated in FIG. 5, have structures in common with each other except for a fuel collision surface and air injection holes, portions of the structure in common with respect to both embodiments are denoted with the same reference numerals. Portions of the second embodiment which are different in structure, but correspond to portions of the first embodiment, are denoted with the same but dashed reference numerals as those of the first embodiment.

Figure 3:
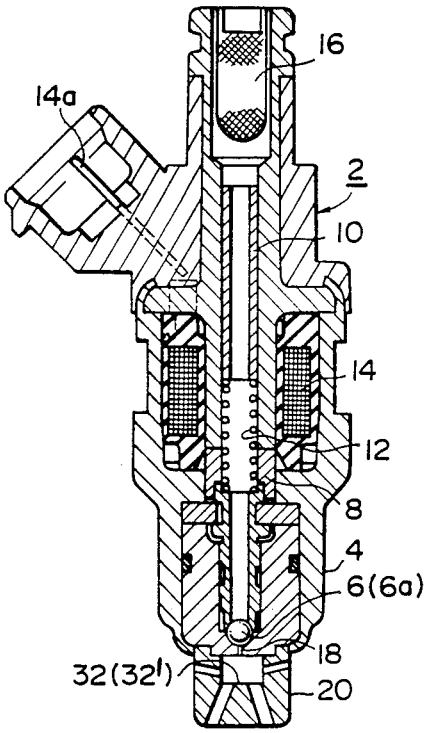
FIG. 3 is an cross-sectional view of the entire fuel injection valve of FIG. 1.

First, structures common with respect to both embodiments will be explained. FIG. 3 illustrates the overall structure of a fuel injection valve 2. Fuel injection valve 2 generally includes an injector body 4 and an adapter 20 coaxially coupled to injector body 4. Fuel injection valve 2 further includes a needle valve 6, which may comprise a ball valve 6', movable in an axial direction of injector body 4; a movable core 8 contacting or coupling with needle valve 6 so as to be able to push needle valve 6 in the axial direction of injector body 4; a fixed core 10, provided so as to oppose movable core 8, for magnetically attracting movable core 8 in the axial direction of injector body 4; a spring 12, provided so as to contact one end of movable core 8, for biasing movable core 8 in a direction away from fixed core 10; a coil 14 for generating a magnetic flux path through fixed core 10, movable core 8 and injector body 4 to attract movable core 8 to fixed core 10 when electric current flows in coil 12; and a strainer 16, provided in a fuel path, for filtering foreign particles which may be included in the fuel. Electric current is supplied to coil 14 through a terminal 14a. Fuel, which is controlled in pressure so as to have a constant pressure increment with respect to a changeable intake manifold pressure, is supplied to fuel injection valve 2. Electric current is intermittently supplied to coil 14 so that movable core 8 is intermittently attracted to fixed core 10 against the biasing force of spring 12 to thereby cause needle valve 6 to intermittently disengage a valve seat **4*b* and to cause the fuel to be intermittently injected. The amount of fuel to be injected is controlled by changing a period of ON time of the intermittent supply of electric current to coil 14** in accordance with an output signal from an engine control computer (not shown).

Figure 4:
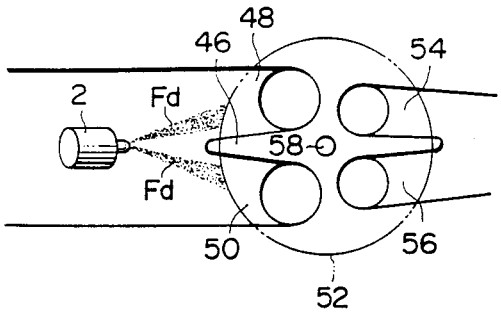
FIG. 4 is a schematic plan view of a four valve cylinder on which the fuel injection valve of FIG. 3 is mounted.
Figure 5:
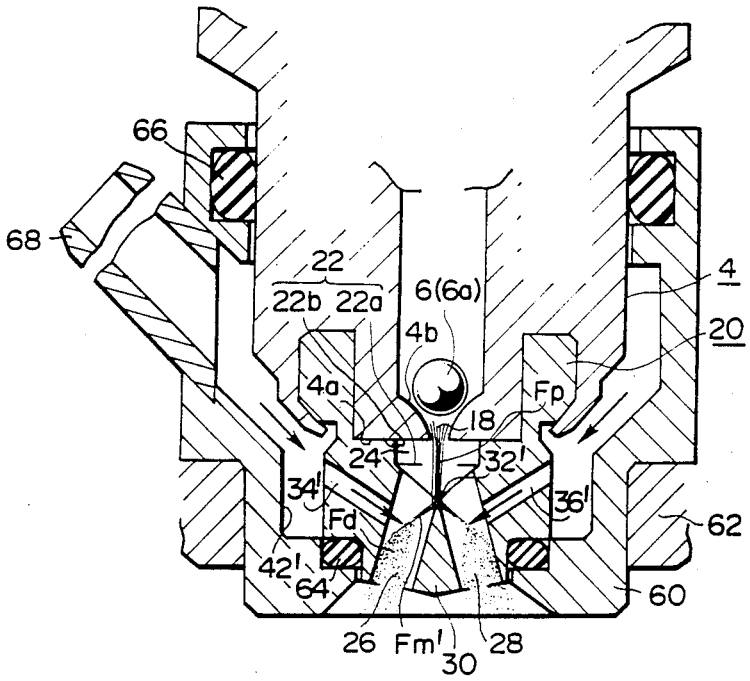
FIG. 5 is a partial cross-sectional view of a fuel injection valve with an air assist adapter in accordance provided with a second embodiment of the present invention in which the adapter and adjacent parts are illustrated.

FIG. 4 illustrates how fuel injection valve 2 is installed in a multiport engine, for example, in an engine having two intake ports 48 and 50 and two exhaust ports 54 and 56 per cylinder Intake ports 48 and 50 are separated from each other by a port dividing wall 46. Fuel injection valve 2 is located upstream of port dividing wall 46 so that the fuel Fd injected from fuel injection valve 2 flows into each of intake ports 48 and 50. A spark plug 58 is located at a position of a cylinder 52 surrounded by four valves including two intake valves and two exhaust valves.

Figure 2:
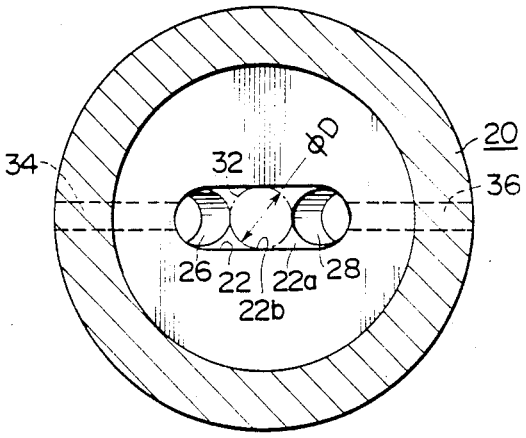
FIG. 2 is a cross-sectional view taken along line II-II of FIG. 1.

As shown in FIGS. 1 and 2 or in FIG. 5, injector body 4 has a fuel injection hole 18 for injecting a fuel in a slug-like pattern. Because a lowermost end of needle valve 6 ends at a position above an uppermost end of fuel injection hole 18, the flow, pattern of the fuel injected through fuel injection hole 18 is a solid slug-like pattern. Injector body 4 has lower surface **4*a* at which fuel injection hole 18** opens.

Adapter 20 coupled to injector body 4 generally includes a recessed concave portion 22, a fuel collision surface 32 (32' in the second embodiment), two air injection holes 34 and 36 (34' and 36' in the second embodiment), and two injected fuel paths 26 and 28. More particularly, as shown in FIG. 1 or FIG. 5, concave portion 22 defines a dead volume portion 24 therein in cooperation with lower surface 4a of injector body 4. The slug-like pattern of fuel Fp injected from fuel injection hole 18 flows in dead volume portion 24 toward fuel collision surface 32 or 32' substantially in parallel with the axis of adapter 20, though a diameter of the slug-like pattern is slightly decreased at a downstream portion of the slug-like pattern As shown in FIG. 2, concave portion 22 has a transverse cross-section of the shape of one of a race track shape, an ellipse, and a circle. Preferably, the transverse cross-section of concave portion 24 is a race track shape, which is defined by two opposed straight line segments forming the sides of the cross-section and two opposed curved line segments connected to the straight line segments forming the ends of the cross-section. As shown in FIG. 1 or 5, concave portion 22 has a side surface 22*b* extending in parallel with the axis of adapter 20 and a bottom surface 22*a* extending in a direction perpendicular to the axis cf adapter 20.

As shown in FIG. 1 or FIG. 5 fuel collision surface 32 or 32' is located so as to be spaced from and axially opposite to fuel injection hole 18 and lets the fuel flowing from fuel injection hole 18 toward fuel collision surface 32 or 32' collide with fuel collision surface 32 or 32' to thereby change the fuel flow direction from a direction parallel to the axis of adapter 20 to a direction away from the axis of adapter 20 and to change the fuel flow pattern from the slug-like pattern to a membrane-like pattern. Adapter 20 further includes a dividing wall 30 located between fuel injected paths 26 and 28. Dividing wall 30 operates so as to divide the fuel flowing from fuel injection hole 18 into two portions to let each of the two portions of fuel flow into each injected fuel path 26 or 28. Fuel collision surface 32 or 32' is defined by one portion of a top surface of dividing wall 30. Fuel collision surface 32 or 32' is located at a level with or downstream of bottom surface 22*a* of concave portion 22 in the fuel flow direction so that a sufficient distance remains between fuel collision surface 32 or 32' and fuel injection hole 18 to prevent a back pressure of fuel within injector body 4 from being affected by the collision of the fuel with fuel collision surface 32 or 32'.

As shown in FIG. 1 or FIG. 5, air injection holes 34 and 36 or 34' and 36' are formed in adapter 20 so as to inject air steams against the membrane-like pattern of fuel Fm or Fm' from above the membrane-like pattern of fuel Fm or Fm' to thereby assist the fuel in being atomized. Each air injection hole 34, 36 or 34', 36' is located on a respective side of fuel collision surface 32 or 32'; and the axis of each air injection hole 34, 36 or 34', 36' is located in a single plane including axes of injected fuel paths 26 and 28 and the axis of adapter 20. Each air injection hole 34, 36 or 34', 36' obliquely extends from a lowermost end thereof in a direction upward and away from the axis of adapter 20.

As shown in FIG. 1 or FIG. 5, injected fuel paths 26 and 28 are formed on sides of fuel collision surface 32 or 32' so as to the atomized fuel Pd and the injected air pass therethrough into intake ports 48 and 50 of the engine. Each injected fuel path 26, 28 has a circular cross-section in a direction perpendicular to an axis of each injected fuel path 26, 28 and extends straight over the entire length thereof and obliquely with respect to the axis of adapter 20, so as to be spaced farther from the axis of adapter 20 at a lower portion of each injected fuel path 26, 28 than at an upper portion of each injected fuel path 26, 28.

Next, structures specific to each embodiment will be explained.

With respect to the first embodiment, as shown in FIGS. 1 and 2, fuel collision surface 32 comprises a flat surface extending in a direction perpendicular to the axis of adapter 32. Fuel collision surface 20 is located in the same plane as bottom surface 22*a* of concave portion 22 and comprises one portion of bottom surface 22*a* of concave portion 22. Each air injection hole 34, 36 is formed in adapter 20 so as to open to dead volume portion 24 at side surface 22b of concave portion 22, so that the air obliquely injected from each air injection hole 34, 36 collides with the membrane-like pattern of fuel Fm within the circular cross-section of an upper end of each injected fuel path 26, 28.

The diameter of an area of fuel collision surface 32 effective in changing the fuel flow pattern from the slug-like pattern to the membrane-like pattern, which is nearly equal to a diameter D (see FIG. 2) of a circle tangentially contacting upper end cross-sections of injected fuel paths 26 and 28, is one to five times the diameter d (see FIG. 1) of fuel injection hole 18 formed in injector body 4.

As shown in FIG. 1, adapter 20 is coupled to a wall 38 of the intake port of the engine. Wall 38 has a bore penetrating wall 38 and a lower portion of fuel injection valve 2 is inserted into the bore. The bore has a groove 42 defining an air path therein in cooperation with an outside surface of adapter 20. The air path is fluidically connected via an air supply path 44 to an air supply source (not shown) and communicates with each air injection hole 34, 36 so as to deliver the air supplied from the air source to each air injection hole 34, 36. The air path defined in groove 42 is separated from the atmosphere and the intake gas by seal members 40.

With respect to the second embodiment, as shown in FIG. 5, fuel collision surface 32' comprises an upwardly convex, curved surface. Fuel collision surface 32 is located downstream of bottom surface 22*a* of concave portion 22. Each air injection hole 34', 36' is located so as to open to each injected fuel path 26, 28 at an inside surface of each injected fuel path 26, 28 so that the air injected from each air injection hole 34', 36' collides with the membrane-like pattern of fuel Fm' within each injected fuel path 26, 28. Each air injection hole 34', 36' is directed to inject air against an upstream portion of the membrane-like pattern of fuel Fm' before the fuel in the membrane-like pattern collides with the inside surface of each injected fuel path 26, 28.

As shown in FIG. 5, adapter 20 is coupled to a wall of the intake port of the engine or a holding member 62 via an air delivery member 60. Air delivery member 60 has a bore penetrating air delivery member 60, and a lower portion of fuel injection valve 2 is inserted into the bore. Air delivery member 60 has an annular groove 42', which defines an air path therein in cooperation with an outside surface of adapter 20 The air path is fluidically connected to an air supply source (not shown) via an air inlet 68 and is communicated with air injection holes 34' and 36' so as to supply the air supplied from the air source to air injection holes 34' and 36'. Seal members 6 and 66 separate the air path from the atmosphere and the intake gas.

Next, operation of fuel injection valve 2 will be explained.

First, operation common to each embodiment will be explained. The fuel injected from fuel injection hole 18 flows within dead volume portion 24 toward fuel collision surface 32 or 32' in a solid slug-like pattern along the axis of adapter 20. The slug-like pattern of fuel Fp then collides with fuel collision surface 32 or 32' for a first atomization. Because of the collision, the fuel changes its flow direction from a direction parallel to the axis of adapter 20 to a direction away from the axis of adapter 20, and the fuel flows in a membrane-like pattern. When the membrane-like pattern of fuel Fm or Fm' flows radially outwardly, the thickness of the membrane gradually decreases in proportion to an increase in radius, and finally the membrane will break apart by itself. In this way, the fuel undergoes a second atomization. Then, the air injected from air injection holes 34 and 36 or 34' and 36' collides with the breaking-up membrane-like pattern of fuel Fm or Fm' to assist in further atomization of the fuel in adapter 20. Because of the collision of the injected air with the fuel, the fuel is atomized a third time, and the membrane-like pattern of fuel Fm or Fm' is changed into a fuel flow of very fine fuel drops. The greatly atomized fuel is mixed with the air injected from air injection holes 34 and 36 or 34' and 36' and is injected through injected fuel paths 26 and 28 into the intake port of the engine.

The air injected from air injection holes 34 and 36 or 34' and 36' also operates to prevent the fuel from flowing up to and adhering onto side surface **22*b* of concave portion 22 and the inside surfaces of injected fuel paths 26 and 28. If the fuel were to adhere onto the surfaces of adapter 20** too much, the mixed gas would become too lean, and when the adhering fuel was released from the surfaces, the mixed gas would become too rich. Such alternation would make the operation of the engine unstable as well as increasing the fuel consumption.

Next, operation specific to each embodiment will be explained.

With respect to the first embodiment, the fuel having collided with fuel collision surface 32 flows in a direction perpendicular to the axis of adapter 20 in a plate-like (membrane-like) pattern of flow. The air injected from fuel injection holes 34 and 36 collides with the plate-like pattern of fuel Fm and bends the fuel flow direction from the direction perpendicular to the axis of adapter 20 to a direction along the axis of each injected fuel path 26, 28. As a result, atomization of the fuel is promoted and the tendency of the fuel to adhere onto side surface 22b of concave portion 22 and the inside surface of each injected fuel path 26, 28 is suppressed.

With respect to the second embodiment, the fuel having collided with fuel collision surface 32' flows in an oblique, downward direction in a hollow cone-like (membrane-like) pattern. The air injected from air injection holes 34' and 36' collides with the cone-like pattern of fuel Fm' to bend the fuel flow direction to a direction along the axis of each injected fuel path 26, 28. As a result, atomization of the fuel is promoted and the tendency of the fuel to adhere onto the inside surface of each injected fuel path 26, 28 is suppressed.

As will be apparent from the above description, the following effects are obtained in accordance with the present invention.

First, the fuel is greatly atomized because of the three steps, that is, the collision effect of the fuel with fuel collision surface 32 or 32', the self-breakage of the membrane-like pattern of fuel Fm or Fm', and the collision of the air injected from air injection holes 34 and 36 or 34' and 36' with the membrane-like pattern of fuel Fm or Fm'. Because of this fuel atomization, a good and stable combustion of the fuel in the cylinder is obtained to thereby minimize the fuel consumption.

Secondly, the air injected from air injection holes 34 and 36 or 34' and 36' also operates to prevent the fuel from flowing to and adhering onto the surfaces of adapter 20. This promotes a stable combustion of the fuel and a stable operation of the engine.

Thirdly, because the atomized fuel is well mixed with the air, other fuel-air mixing means such as a swirl generating mechanism is almost unnecessary, thereby making the engine compact and the engine structure simple.

Although only a few embodiments of the invention have been described in detail above, it will be appreciated by those skilled in the art that various modifications and alterations can be made to the particular embodiments shown without materially departing from the novel teachings and advantages of the invention. Accordingly, it is to be understood that all such modifications and alterations are included within the spirit and scope of the invention as defined by the following claims.

What is claimed is:

1. A fuel injection value with an air assist adapter for internal combustion engine comprising:

an injector body having a fuel injection hole for injecting fuel in a slug-like pattern; and an adapter coaxially coupled to the injector body, the adapter including:

a recessed concave portion for defining a dead volume portion therein such that fuel injected from the fuel injection hole flows in a slug-like pattern from the fuel injection hole into the dead volume portion;

a fuel collision surface, spaced from and axially opposite to the fuel injection hole, for allowing fuel flowing from the fuel injection hole toward the fuel collision surface to collide with the fuel collision surface to thereby change the fuel flow direction from a first direction toward the fuel collision surface to a second direction away from an axis of the adapter and to change the fuel flow pattern from the slug-like pattern to a membrane-like pattern;

means, formed in the adapter, for injecting air against the membrane-like pattern of fuel from above the membrane-like pattern of fuel in a direction opposite the second direction to thereby assist in atomization of the fuel, the air injecting means comprising two air injection holes; and two injected fuel paths, formed on sides of the fuel collision surface, for conducting the atomized fuel and the injected air into an intake port of an engine, each fuel path having one end lying in a plane including the fuel collision surface.

2. The fuel injection valve according to claim 1 further comprising a needle valve, a lowermost end of which ends at a position above an uppermost end of the fuel injection hole so that the slug-like pattern of fuel formed in the dead volume portion comprises a solid slug-like pattern.

3. The fuel injection valve according to claim 1, wherein the concave portion has a transverse cross-section of the shape of one of a race track shape, an ellipse, and a circle.

4. The fuel injection valve according to claim 3, wherein the transverse cross-section of the concave portion is a race track shape.

5. The fuel injection valve according to claim 1, wherein the concave portion has a side surface extending in parallel with the axis of the adapter and a bottom surface extending in a direction perpendicular to the axis of the adapter.

6. The fuel injection valve according to claim 1 further comprising a dividing wall located between the injected fuel paths, the fuel collision surface being defined by one portion of a top surface of the dividing wall.

7. The fuel injection valve according to claim 1, wherein the fuel collision surface is located at a position level with or downstream of a bottom surface of the concave portion in a fuel flow direction.

8. The fuel injection valve according to claim 1, wherein each air injection hole is located on an opposite side of the fuel collision surface, and the axis of each air injection hole is located in a single plane including axes of the injected fuel paths and the axis of adapter.

9. The fuel injection valve according to claim 1, wherein each air injection hole obliquely extends from a lowermost end thereof in a direction upward and away from the axis of the adapter.

10. The fuel injection valve according to claim 1, wherein each injected fuel path has a circular cross-section in a direction perpendicular to an axis of each injected fuel path and extends straight over the entire length thereof and obliquely with respect to the axis of the adapter so as to be spaced farther from the axis of the adapter at a lower portion of each injected fuel path than at an upper portion of each injected fuel path.

11. The fuel injection valve according to claim 1, wherein the fuel collision surface comprises a flat surface extending in a direction perpendicular to the axis of the adapter and comprising one portion of a bottom surface of the concave portion, and each air injection hole is formed in the adapter so as to open to the dead volume portion at a side surface of the concave portion, so that air obliquely injected from each air injection hole collides with the membrane-like pattern of fuel within a circular cross-section of an upper end of each injected fuel path.

12. The fuel injection valve according to claim 11, wherein a diameter of an area of the fuel collision surface effective in changing a fuel flow pattern from the slug-like pattern to the membrane-like pattern, which is nearly equal to a diameter of a circle tangentially contacting upper end cross-sections of the injected fuel paths, is one to five times a diameter of the fuel injection hole formed in the injector body.

13. The fuel injection valve according to claim 1, wherein the fuel collision surface comprises an upwardly convex, curved surface and is located downstream of a bottom surface of the concave portion, and each air injection hole is located so as to open to each injected fuel path at an inside surface of each injected fuel path, so that air injected from each air injection hole collides with the membrane-like pattern of fuel within each injected fuel path.

* * * * *

UNITED STATES PATENT AND TRADEMARK OFFICE

CERTIFICATE OF CORRECTION

PATENT NO. : 4,982,716

DATED : January 8, 1991

INVENTOR(S) : Keiso Takeda, et al.

It is certified that error appears in the above-identified patent and that said Letters Patent is hereby corrected as shown below:

| Column | Line | |
|---|---|---|
| 2 | 32 | After "cylinder" insert --.--; after "carbon" delete ",". |
| 3 | 20 | Before "atomized" insert --is--. |
| 3 | 41 | Change "an" to --a--. |
| 4 | 47 | After "flow" delete ",". |
| 5 | 47 | After "so as to" insert --permit--; after "air" insert --to--. |
| 5 | 62 | Change "20" to --32--. |
| 7 | 55 | Before "good" delete "a". |
| 8 | 10 | Change "value" to --valve--. |
| 8 | 11 | Before "internal" insert --an--. |

UNITED STATES PATENT AND TRADEMARK OFFICE

CERTIFICATE OF CORRECTION

PATENT NO. : 4,982,716

DATED : January 8, 1991

INVENTOR(S) : Keiso Takeda, et al.

It is certified that error appears in the above-identified patent and that said Letters Patent is hereby corrected as shown below:

Column 8, line 22, after "site" delete "to".

Signed and Sealed this

Thirteenth Day of October, 1992

*Attest:*

DOUGLAS B. COMER

*Attesting Officer*

*Acting Commissioner of Patents and Trademarks*